US006052862A

United States Patent [19]

Lowery

[11] Patent Number: 6,052,862

[45] Date of Patent: Apr. 25, 2000

[54] CORD REWINDER FOR A WATER FILTER TYPE VACUUM CLEANER

[75] Inventor: Vernon Lowery, Brandon, Miss.

[73] Assignee: Multicraft International, Brandon, Miss.

[21] Appl. No.: 09/252,619

[22] Filed: Feb. 16, 1999

[51] Int. Cl.[7] ..... A47L 9/26

[52] U.S. Cl. ..... 15/323; 15/353; 15/413

[58] Field of Search ..... 15/323, 413, 412, 15/353

[56] References Cited

U.S. PATENT DOCUMENTS

| | | | |
|---|---|---|---|
| 3,929,210 | 12/1975 | Cutler et al. . | |
| 4,693,734 | 9/1987 | Erickson, Jr. . | |
| 4,701,974 | 10/1987 | Konig et al. | 15/413 |
| 4,924,039 | 5/1990 | McAllise et al. | 15/323 X |
| 5,215,560 | 6/1993 | Lee . | |
| 5,255,768 | 10/1993 | Kasper et al. . | |
| 5,507,446 | 4/1996 | Ditzig . | |
| 5,535,500 | 7/1996 | Stephens et al. . | |
| 5,622,243 | 4/1997 | Kang . | |
| 5,752,997 | 5/1998 | Roth | 15/323 X |

*Primary Examiner*—Chris K. Moore

*Attorney, Agent, or Firm*—Blank Rome Comisky & McCauley LLP

[57] ABSTRACT

A cord rewinder assembly for a wet filter type vacuum cleaner with a moist air discharge outlet includes a conventional cord rewinder and a deflector plate. The deflector plate not only shields the cord rewinder from direct contact with the moist airflow discharge but also functions to remove moisture from the airflow so that it can be utilized to cool the electrical components of the cord rewinder. Incoming air carrying dirt and dust is cleaned by passing the air stream through a canister of water and a series of secondary filters. The clean discharge air, which contains moisture and water vapor, impinges on the deflector plate and is redirected downwardly at a high velocity toward a cavity. The airflow enters the cavity at a lower velocity, passes beneath the deflector plate and reverses direction. The decrease in airflow velocity and the redirection of the airflow allows the moisture and water vapor to drop out of the airflow. The resulting dry airflow is safely directed across and through the cord rewinder to remove heat generated by the electrical components thereof. The heated airflow is then exhausted through a vent with a removable cover. The cord rewinder and deflector plate are coupled to and housed within a box-like panel that may replace the panel or fixture located over the discharge outlet of existing water filter type vacuum cleaners.

23 Claims, 2 Drawing Sheets

CORD REWINDER FOR A WATER FILTER TYPE VACUUM CLEANER

FIELD OF THE INVENTION

The present invention relates to cord rewinding apparatus for vacuum cleaners and more particularly to a cord rewinder assembly for a wet vacuum cleaner having a deflector plate for shielding the cord rewinder from the wet discharge air and for redirecting the wet airflow along a path that drys the air prior to its passing across the cord rewinder.

BACKGROUND OF THE INVENTION

The inclusion of cord rewinder apparatus in dry vacuum cleaners is well known. A typical cord rewinder apparatus includes a reel upon which a power cord is wound. A spring or other biasing means is operatively connected to the reel to rotate the reel in a direction to retract or rewind the power cord when it is at least partially unwound from the reel. Also included is a brake assembly which, in its locked position, frictionally stops rotational movement of the reel in the rewind or retract direction. When rewinding the cord is desired, the brake assembly is disengaged, manually or otherwise, from the reel, thereby unlocking the reel and enabling the biasing means to rotate the reel in the retract direction. Power is coupled from the power cord via electrical components, including conductive strips and contacts disposed on the reel. The contacts are electrically connected to the motor, fan and other electrically-driven components of the vacuum cleaner. Some examples of conventional cord rewinder apparatus for vacuum cleaners are disclosed in U.S. Pat. Nos. 5,255,768 and 5,622,243, the disclosures of which are incorporated herein by reference.

Such conventional cord rewinder apparatus are not suitable for use in wet vacuum cleaners. For a cord rewinder to be included in any device, it must meet the standards outlined by Underwriters Laboratories (UL), including strict maximum temperature rise limits for the electrical components. Currently, most commercially available vacuum cleaners utilize a high amperage draw, which causes the electrical components thereof to heat up to unacceptably high temperatures. To reduce those temperatures and cool the components, dry vacuum cleaners are often equipped with elements, such as baffles or the like, to divert a portion of the vacuum cleaner discharge airflow directly through the coil rewinder and over the heated components to cool them. Using the vacuum discharge airflow as a cooling medium is not feasible for existing wet vacuum cleaners, inasmuch as it is imprudent and unsafe to pass the discharge air, which may contain water vapor, over electrical components. Heretofore, the only cord rewinders that have been able to pass the UL temperature rise tests are those incorporating discharge airflow cooling. As a result, wet vacuum cleaners currently on the market do not include cord rewinders.

In view of the foregoing deficiencies of the conventional apparatus, it would be desirable to provide a UL certifiable wet vacuum cleaner that incorporates a cord rewinder. It would also be desirable to provide a method of and apparatus for cooling the cord rewinder using the discharge airflow as the cooling medium. It would further be desirable to provide a cord rewinder that is compact and readily incorporated in existing wet vacuum cleaners without any modifications or adjustments to the existing vacuum cleaner structure.

SUMMARY OF THE INVENTION

The present invention is directed to a method of and an apparatus for retrofitting a wet vacuum cleaner with a cord rewinder, the temperature of which is controlled using the vacuum discharge airflow. A deflector plate positioned between the vacuum cleaner's discharge outlet and the cord rewinder shields the cord rewinder from direct contact with the wet discharge airflow and further functions to reduce the moisture content of the wet airflow so that it can be utilized to cool the electrical components of the cord rewinder and comply with UL requirements.

According to the apparatus aspects of the invention, the cord rewinder assembly is installed in place of a vent cover on the main housing of a conventional wet vacuum cleaner. The assembly covers the discharge outlet provided in the main housing and is secured in place using the existing bolt pattern for the vent cover. The cord rewinder assembly comprises a deflector plate and a conventional cord rewinder, including a reel and biasing and braking means for controlling rotation of the reel. The cord rewinder and deflector plate are situated inside of and connected to a panel or housing having an open back and a front with a vent provided therein. The deflector plate is positioned such that it shields the cord rewinder from direct contact with the wet discharge airflow. When assembled, the deflector plate divides the panel into three distinct regions or cavities: a small capacity, rear region or cavity that abuts the discharge outlet in the main housing of the vacuum cleaner; a large, front region or cavity in which the cord rewinder is mounted; and a large capacity region or bottom cavity positioned beneath the deflector plate and interconnecting the front and rear regions.

The airflow exiting through the discharge outlet in the main housing of the conventional vacuum cleaner is wet and cannot be used for cooling heated electrical components. According to the present invention, the wet airflow is transformed into a substantially dry airflow. Specifically, the wet airflow enters the rear region of the cord rewinder assembly, impinges upon the deflector plate and is immediately redirected downwardly toward the large capacity bottom cavity. Given the relatively small capacity of the rear region of the assembly, the airflow travels downwardly at a high velocity airflow. As the airflow enters the large capacity bottom cavity, it slows down and reverses direction upwardly substantially 180° toward the front region of the assembly. As a result of the slowing and reversal of the airflow, substantially all the water vapor and moisture carried thereby drops into the bottom cavity. The airflow, which is now substantially moisture free, passes into the front region housing the cord rewinder, travels over and around the cord rewinder, thereby cooling the electrical components thereof, and exits through the vent in the front of the panel. For blowing applications, the vent cover positioned over the vent opening provided in the front panel of the cord rewinder assembly is removed and the free end of a vacuum hose can be secured in the vent opening.

The present invention has immediate and unique applications in the wet vacuum cleaner industry. Existing cord rewinder technology, which has only been applied in dry equipment, can be incorporated into the cord rewinder assembly of the present invention and used with wet vacuum apparatus with high amperage draws while still adhering to the strict temperature rise standards set by UL. Further, existing wet vacuum cleaners, none of which are known to incorporate cord rewinders, can be easily retrofitted with the present invention. For example, retrofitting the commercially available Rainbow® water filter type vacuum cleaner made by Rexair, Inc. of Troy, Mich. 48084 simply involves replacing the removable vent cover panel with the cord rewinder assembly of the present invention. No modifications or adjustments to the existing wet vacuum cleaner is required. The cord rewinder assembly of the invention simply slides into position, is readily electrically connected to the electrical components in the main housing, and is secured in place using the same bolt holes used to secure the vent cover panel of the Rainbow ® vacuum cleaner.

With the foregoing and other objects, advantages and features of the invention that will become hereinafter apparent, the nature of the invention will be more clearly understood by reference to the following detailed description of the invention, the appended claims and to the several views illustrated in the drawings.

DETAILED DESCRIPTION OF THE INVENTION

Figure 1:
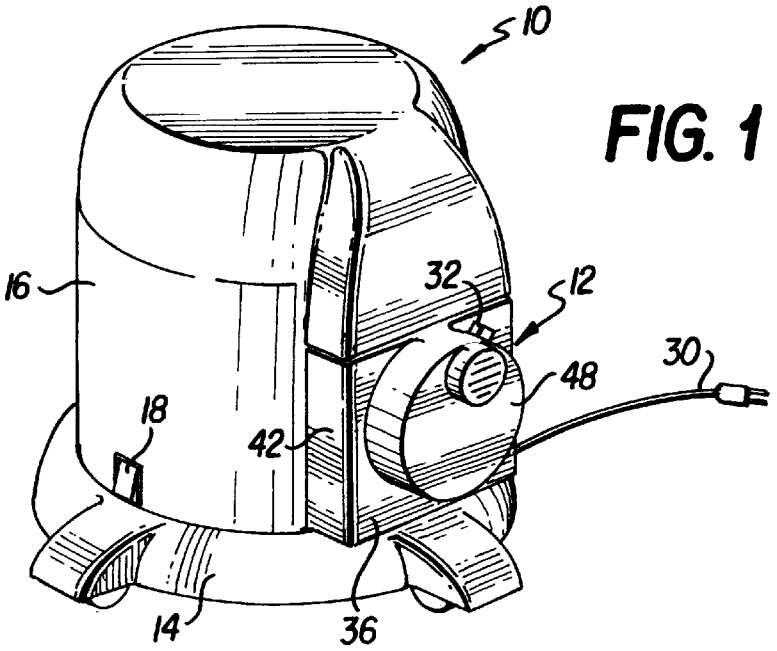
FIG. 1 is a perspective view of a conventional wet vacuum cleaner showing the cord rewinder assembly of the invention mounted to the vacuum cleaner.

Referring now to the drawings, there is illustrated in FIG. 1 a perspective view of a wet vacuum cleaner, which is designated generally by reference numeral 10, retrofitted with a cord rewinder assembly 12 constructed according to the invention. Apparatus 10 is a conventional liquid bath vacuum cleaner known as a Rainbow® wet vacuum cleaner including a water pan 14 detachably connected to a main housing 16 by conventional connecting means, such as latches 18. Although the present invention is described in connection with the Rainbow® wet vacuum cleaner apparatus, it should be understood that the principles of the present invention could be applied to any other design of wet vacuum cleaner to permit use of the wet vacuum discharge air to cool the heated components of the apparatus.

Figure 2:
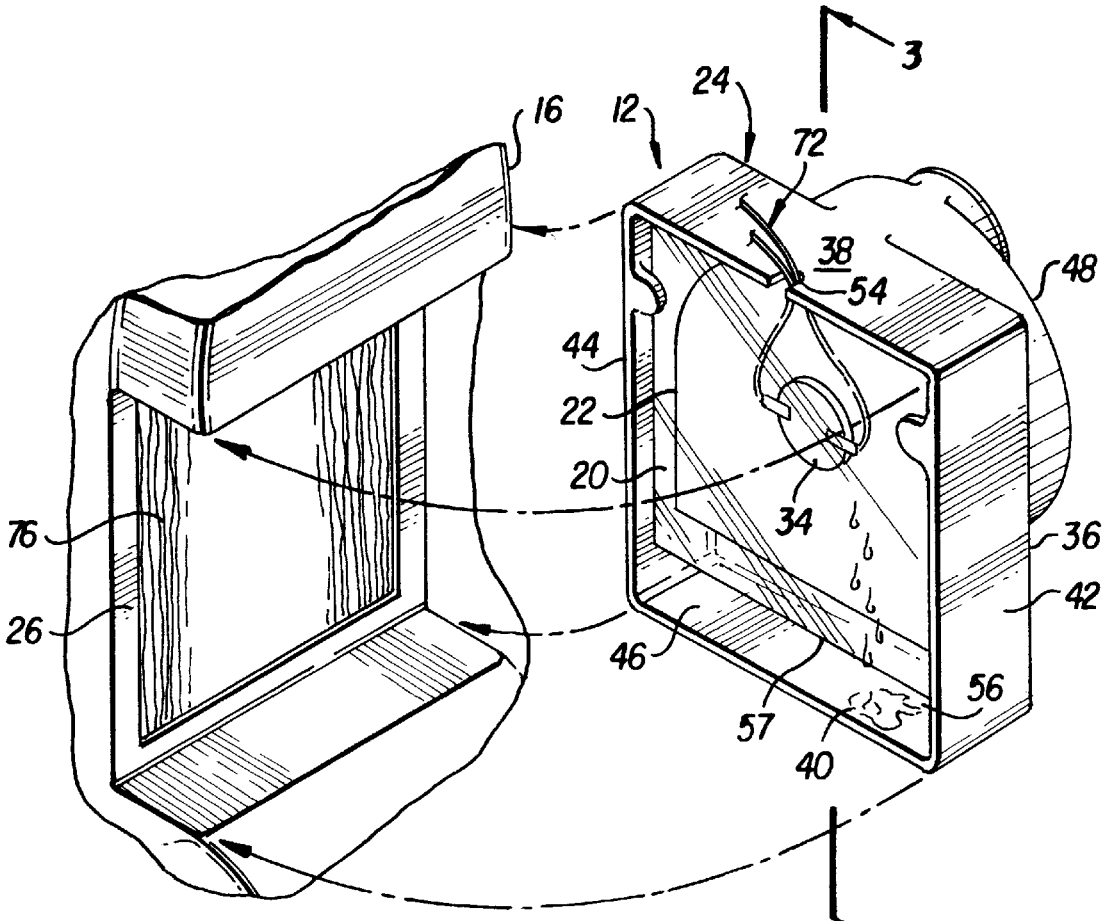
FIG. 2 is an exploded fragmentary perspective view of the cord rewinder assembly of the invention showing the manner of its attachment to the side of the wet vacuum cleaner of FIG. 1.
Figure 3:
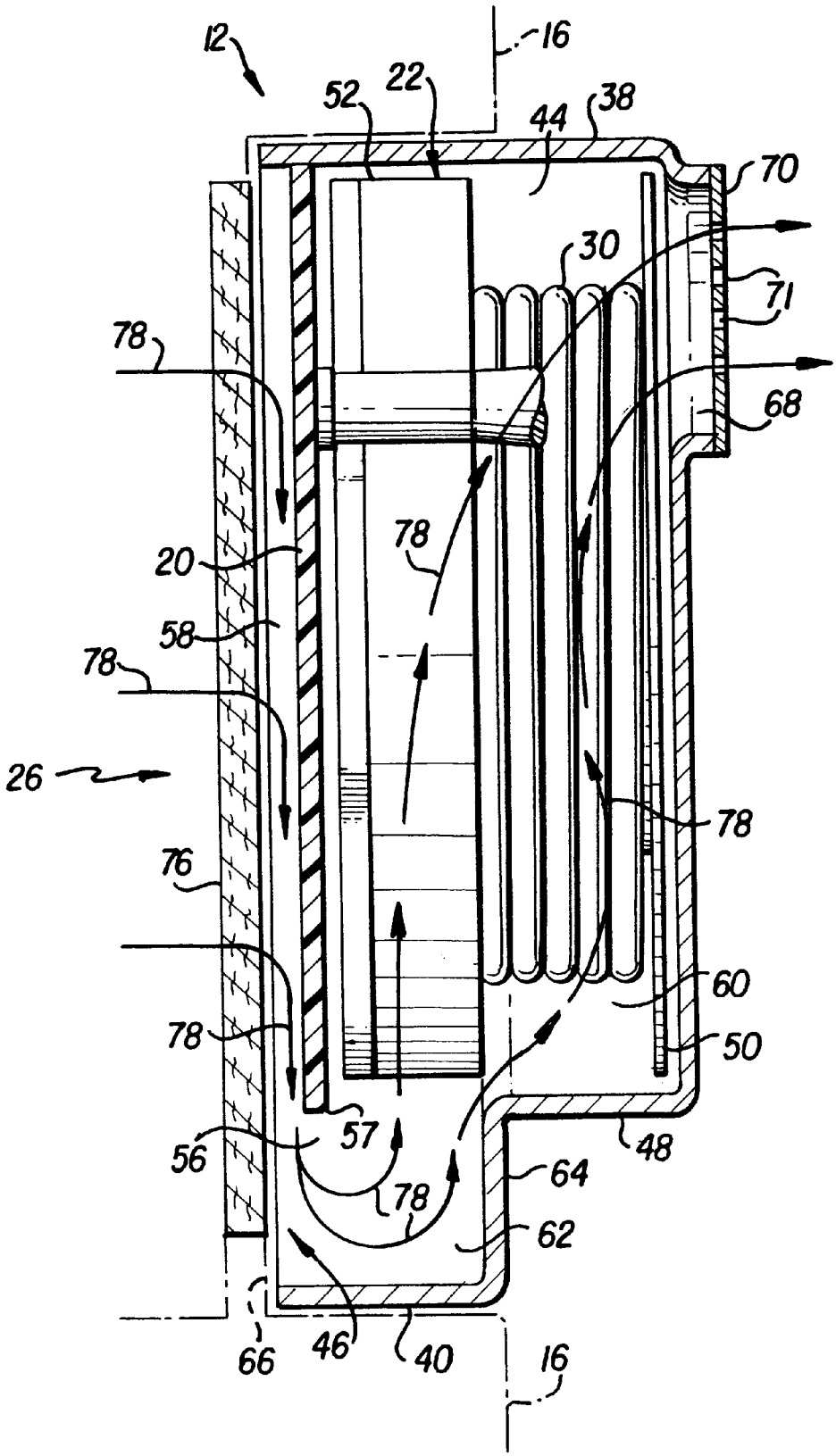
FIG. 3 is a cross-sectional view taken along line 3—3 of FIG. 2 showing the path the discharge airflow takes around the deflector plate and through the cord rewinder.

Referring now to FIGS. 2 and 3, cord rewinder assembly 12, including a deflector plate 20 and a conventional cord rewinder 22, is incorporated into a box-like panel 24 that is mounted over the discharge outlet 26 (FIG. 2) of the housing 16. As shown in FIG. 3, the cord rewinder 22 is a conventional one, including a rotatable reel 28 about which a power cord 30 is wound, biasing means (not shown) for urging the reel 28 in a direction for retract rotation, and a brake assembly (not shown), including a manually actuated release means 32 (FIG. 1), for locking and unlocking the reel 28. Electrical coupling means 34, such as conductive strips, wires and contacts, electrically connect the power cord 30 to a circuit (not shown) for supplying electrical power to the electrically-operated components of the vacuum cleaner 10, i.e., motor and fan assemblies (not shown) located within the housing 16 for creating an airflow through the vacuum cleaner 10. It should be understood that the specific features, elements and structure of the cord rewinder 22, including the coupling means 34, are not important, inasmuch as any cord rewinder would be compatible with the present invention, including those incorporated in cord rewinders for dry vacuum cleaners or other tools or appliances.

Referring to FIGS. 2 and 3, a preferred embodiment of the cord rewinder assembly 12 includes the box-like panel 24 for housing the deflector plate 20 and the cord rewinder 22. Panel 24 has a front wall 36, upper, lower and side walls, 38, 40 and 42 and 44, respectively, extending from the front wall, and an open back 46. The front wall 36 has a housing 48 with a circular cross-section for receiving the reel 28 of the cord rewinder 22. The cord rewinder 22 is situated in the panel 24, with a substantial portion of the reel 28 located inside the housing 48, and flange members 50, 52 extending substantially parallel to the front wall 36 of the panel 24. A notch 54 (FIG. 2) is provided in the upper wall 38 of the panel 24 through which pass electrical wires 72 for joining the power cord 30 to the circuit in the main housing 16. Deflector plate 20, which is preferably a rigid sheet of plastic or Plexiglass®, is located in the panel 24 between the rear flange member 52 of the cord rewinder 22 and the open back 46 of the box-like panel 24. The upper edge and side edges of the deflector plate 20 abut the upper wall 38 and side walls 42,44 of the panel 24, with an open space or bottom cavity 56 being formed between the lower edge 57 of the deflector plate 20 and the lower wall 40 of the panel 24. The deflector plate 20 is sealed along its upper and side edges to the upper and side walls 38, 42 and 44, so that the discharge airflow 78 from the discharge outlet 26 may only proceed downward through open space 56. All edges of the deflector plate 20 extend beyond the outer edges of the cord rewinder 22, thereby preventing any wet air from coming into direct contact with the cord rewinder. Any acceptable connecting means, including bolts, screws, clips and the like, may be used to secure the deflector plate 20 and the cord rewinder 22 to the panel 24.

Referring to FIG. 3, the deflector plate 20 divides panel 24 into a first region or cavity 58 located between the deflector plate 20 and the discharge outlet 26 of the housing 16, a second region or cavity 60 located in the circular housing 48, and a bottom cavity 62 located beneath the deflector plate 20 and defined by the lower wall 40 and side walls 42, 44 of the panel 24, a lower portion 64 of the front wall 36, and a wall 66 of the housing 16 abutting the open back 46 of the panel 24. The first cavity 58 has a much smaller volume than that of the bottom cavity 62. The front wall 36 of the panel 24 has an opening 68 located near the upper periphery thereof through which the airflow is exhausted. The opening 68 is preferably formed as a socket having dimensions such that an end of a vacuum hose can be removably and securely connected thereto for blowing operations. A vent cover 70 with ports 71 is removably positioned over the opening 68 when no hose is attached thereto. An additional opening (not shown) is located in one of the walls of the panel 24 through which the power cord 30 extends.

The cord rewinder assembly 12 is readily mounted on the side wall of the main housing 16 of the vacuum cleaner 10. In existing wet vacuum cleaners, a removable vent cover, which often includes means for securing the power cord thereto, forms a portion of the outer surface of the main housing 16. The panel 24 of the present cord rewinder assembly 12 serves as a direct replacement for that vent cover, with no modifications to the main housing 16 being required.

Referring to FIG. 2, the panel 24 slides into the void left in the side wall of the main housing 16 when the vent cover is removed and covers the entire discharge outlet 26. Wires 72 are fed through the notch 54 in the upper wall 38 of the panel 24 and are connected to a circuit in the main housing 16. The cord rewinder assembly 12 is secured to the main housing 16 in the same manner and using the same or similar connecting means as the vent cover, i.e., using the same bolt pattern.

FIG. 3 best illustrates how the present invention operates. As in all existing wet vacuum cleaners, cleaning air is suctioned into the vacuum cleaner and passes through the water pan 14, where dust and other particles are removed therefrom. The cleansed air then passes through filters 76 (FIGS. 2 and 3) located in the discharge outlet 26, where any additional particles are removed. When the present invention is installed, the clean discharge airflow 78, instead of being exhausted to the surrounding environment, is expelled into the cord rewinder assembly 12. Airflow 78 passing into panel 24 is clean, but contains water vapor or moisture.

It is important that the airflow 78 be substantially dry prior to contacting any electrical components of the cord rewinder. The present invention accomplishes that objective by positioning the deflector plate 20 between the discharge outlet 26 and the cord rewinder 22. As the cleansed, moist airflow 78 exits the discharge outlet 26 in the main housing 16 of the vacuum cleaner 10, it enters small volume cavity 58. Deflector plate 10 completely shields at least the cord rewinder 22 from direct contact with the moist airflow 78 and redirects the airflow 78 downwardly toward open space 56, the only exit from cavity 58. Given the relatively small volume of cavity 58, the airflow 78 proceeds downwardly and through the open space 56 at a high velocity. That high speed airflow 78 immediately enters the large volume bottom cavity 62 located beneath the deflector plate 20 and the cord rewinder 22. Importantly, no portion of the discharge airflow 78 comes in contact with the cord rewinder without passing through cavity 62. It is in cavity 62 that the airflow 78 slows down, makes an approximate 180° turn, and proceeds upwardly into cavity 60, where the cord rewinder 22 is located. As the airflow 78 slows and turns in cavity 62, water vapor and moisture drops from the airflow 78. By the time the airflow 78 enters cavity 60, it is substantially dry and safely passes around and over the cord rewinder 22, including the electrical components to cool the same. Because of the relatively high amperage draw of the cord rewinder 22, the electrical components thereof heat up. By passing the dried airflow 78 through cavity 60, the generated heated is carried off by the airflow 78, thereby cooling the components. The airflow 78, now heated and dry, is exhausted to the atmosphere through vent opening 68 in the panel 24.

While the invention is especially useful in the embodiments shown in FIGS. 1–3 and described above, it may also be effective using modified configurations. For example, the location of the open space 56 between the deflector plate 20 and the wall of the panel 24 may be changed and the orientation and shape of the deflector plate 20 modified while still providing for the effectiveness of the device. Other arrangements and means for drying the wet air may also be incorporated without departing from the scope of the present invention. Further, the dry airflow may be directed to other regions of the vacuum cleaner to cool the motor and/or other components which generate heat during their operation. Also, the sizes, shapes and other dimensions and features of the constituent parts of the cord rewinder assembly may be modified. In addition, while the invention has been described for use in a wet type vacuum cleaner, it should be readily understood that it is useful in any application or apparatus where a substantially dry airflow is desired.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A wet vacuum cleaner apparatus comprising a main housing having a discharge outlet for discharging moist airflow from said vacuum cleaner and a cord rewinder assembly connected to said main housing over said discharge outlet, said cord rewinder assembly comprising a cord rewinder and a deflector plate positioned between said discharge outlet and said cord rewinder for redirecting the moist airflow to remove moisture from the airflow.

2. Apparatus according to claim 1, wherein said cord rewinder assembly further comprises a panel for enclosing said cord rewinder and deflector plate, said panel being connected to said main housing.

3. Apparatus according to claim 2, wherein said cord rewinder assembly is retrofitted to said apparatus, said main housing having a fastener arrangement for connecting a vent panel over said discharge opening, said panel being connected to said main housing in place of said vent panel without modifying the fastener arrangement of said main housing.

4. Apparatus according to claim 2, wherein said panel has a front, upper, side and lower walls and an open back, said deflector plate extending between the walls of said panel and dividing said panel into a first cavity located between said deflector plate and said open back, a second cavity located between said deflector plate and the front wall of said panel, and a bottom cavity located beneath said deflector plate, said bottom cavity connecting said first cavity and said second cavity.

5. Apparatus according to claim 4, wherein said first cavity has a smaller volume than said bottom cavity.

6. Apparatus according to claim 4, wherein said panel has an opening for venting airflow from said second cavity.

7. Apparatus according to claim 6, wherein said opening is a socket for securing a vacuum hose thereto.

8. Apparatus according to claim 6, further comprising a removable cover over said opening, said cover having ports provided therein for venting said airflow.

9. Apparatus according to claim 4, wherein said deflector plate has upper, lower and side edges, said upper and side edges of said deflector plate being sealed to said upper and side walls of said panel, respectively, the lower edge of said deflector plate being spaced from said lower wall of said panel.

10. Apparatus according to claim 1, wherein said deflector plate redirects the moist airflow through about 180° to remove moisture therefrom.

11. A cord rewinder apparatus comprising a rotatable reel for supporting a power cord, means for coupling said power cord to an electrically-driven device, and means for cooling said rotatable reel and said coupling means, said cooling means including means for redirecting a moist discharge airflow to substantially remove the moisture therefrom prior to passing said airflow across said rotatable reel and coupling means.

12. Apparatus according to claim 11, wherein said redirecting means comprises a deflector plate positioned between said discharge airflow and said rotatable reel and coupling means.

13. Apparatus according to claim 12, further comprising a panel for housing said rotatable reel and coupling means and said deflector plate.

14. Apparatus according to claim 13, wherein said panel has a front wall and side, upper and lower walls extending from said front wall, and an open back, said reel and coupling means being located between said front wall of said panel and said deflector plate.

15. Apparatus according to claim 14, wherein said front wall of said panel has an opening provided therein, and further comprising a cover having ports therein, said over being removably located over said opening.

16. A vacuum apparatus comprising a wet vacuum cleaner having a discharge outlet for discharging a moist airflow from said vacuum cleaner, a cord rewinder positioned over said discharge outlet, and means located between said discharge outlet and said cord rewinder for removing moisture from said moist airflow to form a less moist airflow and directing the less moist airflow over the cord rewinder.

17. A method of cooling electrical components of a cord rewinder of a water filter type vacuum cleaner having a moist airflow discharge comprising the steps of:

redirecting the moist airflow discharge to remove moisture therefrom and form a substantially dry airflow; and passing said substantially dry airflow over said cord rewinder.

18. Method according to claim 17, wherein the step of redirecting said moist airflow discharge comprises deflecting said discharge airflow from a first cavity having a first volume to a second cavity having a greater second volume to decrease the velocity of said discharge airflow, and changing the direction of travel of said discharge airflow through about 180°.

19. Method according to claim 18, further comprising exhausting said dry airflow from said vacuum cleaner after passing said dry airflow over said cord rewinder.

20. Method according to claim 17, wherein the step of redirecting said moist airflow discharge further comprises deflecting said discharge airflow with a deflector plate downwardly from a back surface to a front surface thereof to a bottom cavity positioned beneath said deflector plate and simultaneously reducing the velocity thereof then directing said discharge airflow upwardly into a front cavity located at the front surface of said deflector plate, said cord rewinder being located in said front cavity.

21. Method of retrofitting a wet vacuum cleaner with a cord rewinder assembly, said vacuum cleaner having a moist air discharge outlet with a fixture overlying the outlet, said fixture being secured over said outlet with a fastener arrangement, comprising the steps of:

removing the fixture overlying the discharge outlet of said vacuum cleaner;

placing said cord rewinder assembly over said discharge outlet;

electrically connecting said cord rewinder assembly to an electrical circuit of said vacuum cleaner; and mechanically securing said cord rewinder assembly to said vacuum cleaner using at least a part of said fastener arrangement.

22. Method according to claim 21, wherein said cord rewinder assembly comprises a deflector plate and a cord rewinder, and wherein the step of placing said cord rewinder assembly over said discharge outlet further comprises the step of positioning said deflector plate between said discharge outlet and said cord rewinder so as to redirect the moist discharge air from said outlet with said deflector plate and substantially dry the same.

23. Method according to claim 21, wherein said fastener arrangement includes a plurality of bolt holes formed in said vacuum cleaner, said bolt holes being used to connect the cord rewinder assembly to said vacuum cleaner.

* * * * *